United States Patent [19]

Teich

[11] 4,342,896

[45] Aug. 3, 1982

[54] RADIATING MODE STIRRER HEATING SYSTEM

[75] Inventor: Wesley W. Teich, Wayland, Mass.

[73] Assignee: Raytheon Company, Lexington, Mass.

[21] Appl. No.: 177,309

[22] Filed: Aug. 8, 1980

Related U.S. Application Data

[63] Continuation of Ser. No. 954,718, Oct. 24, 1978, abandoned, which is a continuation of Ser. No. 754,064, Dec. 23, 1976, abandoned.

[51] Int. Cl.[3] ..... H05B 6/72

[52] U.S. Cl. ..... 219/10.55 F; 219/10.55 R

[58] Field of Search ..... 219/10.55 F, 10.55 R, 219/10.55 M, 10.55 E

[56] References Cited

U.S. PATENT DOCUMENTS

| | | | |
|---|---|---|---|
| 2,961,520 | 11/1960 | Long | 219/10.55 F |
| 3,265,780 | 8/1966 | Long | 219/10.55 F |
| 3,388,231 | 6/1968 | Staats | 219/10.55 F |
| 3,439,143 | 4/1969 | Cougoule | 219/10.55 F |
| 3,440,385 | 4/1969 | Smith | 219/10.55 R |
| 3,619,536 | 11/1971 | Boehm | 219/10.55 F |
| 3,746,823 | 7/1973 | Whiteley | 219/10.55 F |
| 3,851,133 | 11/1974 | Dygve et al. | 219/10.55 F |
| 3,872,276 | 3/1975 | Corcoran | 219/10.55 F |
| 4,028,521 | 6/1977 | Uyeda et al. | 219/10.55 F |
| 4,037,071 | 7/1977 | Kaufman, Jr. et al. | 219/10.55 F |

FOREIGN PATENT DOCUMENTS

| | | | |
|---|---|---|---|
| 2312165 | 12/1976 | France | 219/10.55 F |
| 42-468191 | 3/1967 | Japan | 219/10.55 F |

*Primary Examiner*—B. A. Reynolds
*Assistant Examiner*—Philip H. Leung
*Attorney, Agent, or Firm*—William R. Clark; Milton D. Bartlett; Joseph D. Pannone

[57] ABSTRACT

A microwave heating system having a rotary multiport microwave radiator positioned in a cavity and having radiating ports at different distances from the axis of rotation which direct overlapping radiation patterns at a body to be heated. A combination heater may be used having a resistive heater positioned in regions around the outside of the rotary structure to supply heat to the body.

3 Claims, 5 Drawing Figures

FIG. 4
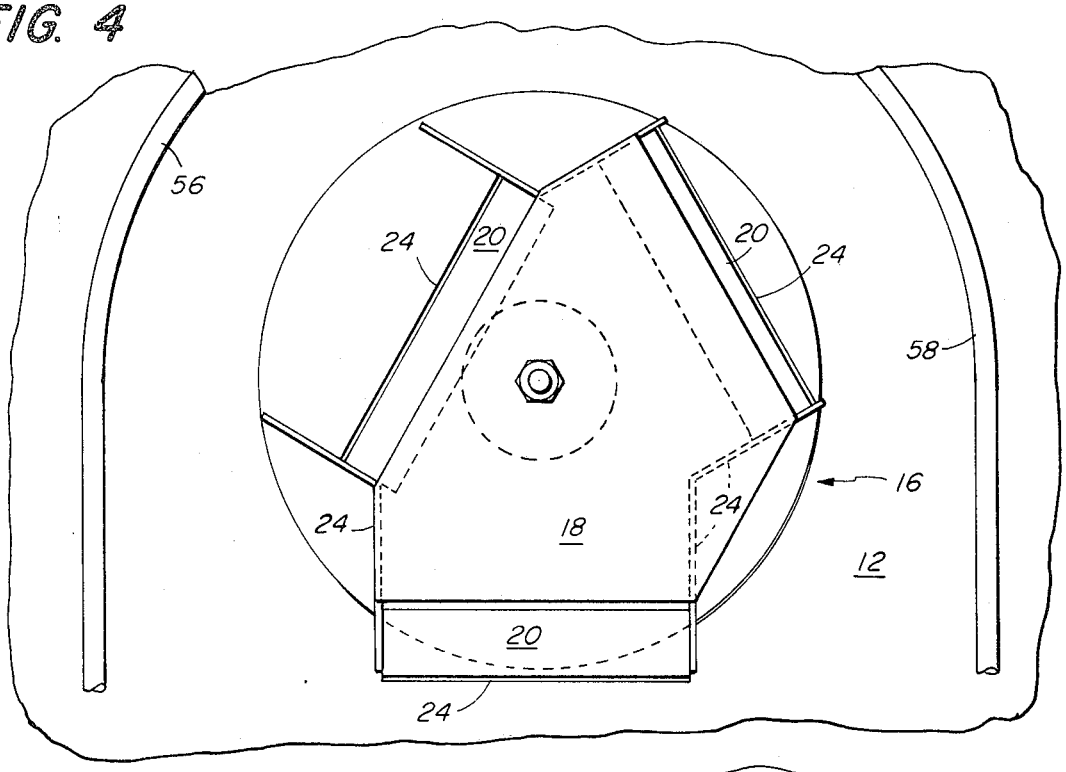
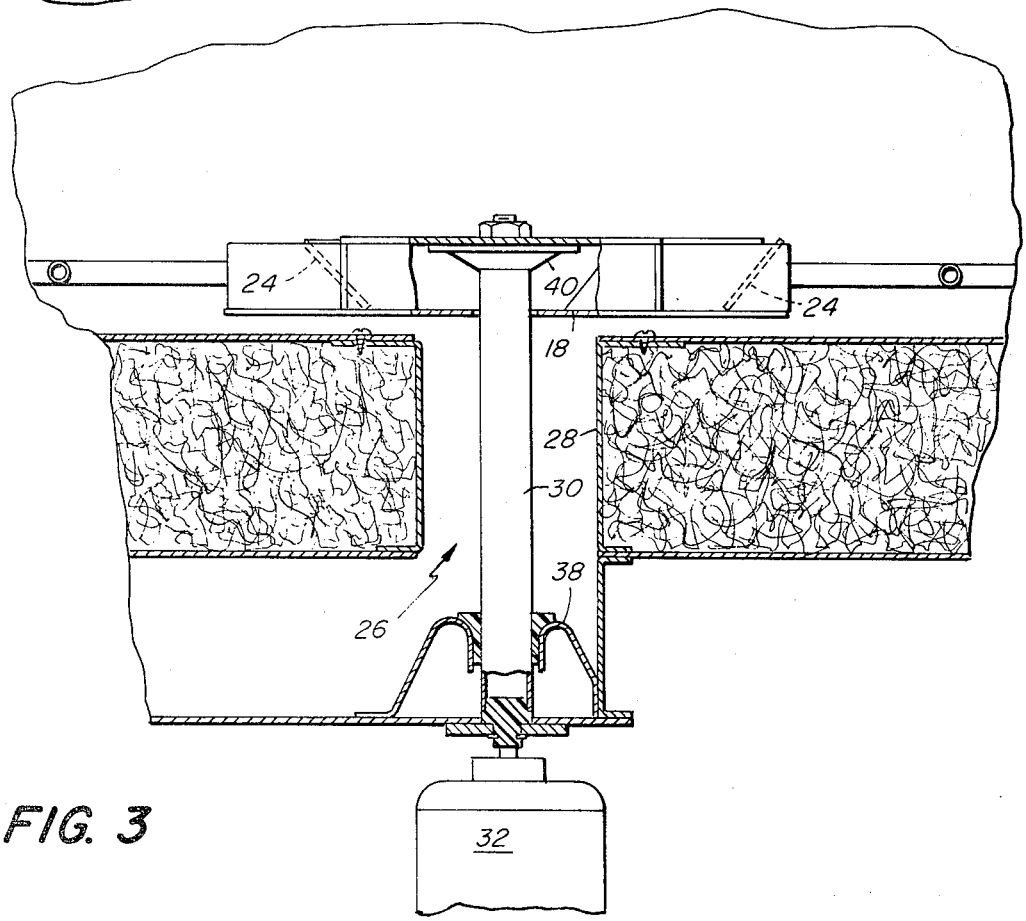
FIG. 3

RADIATING MODE STIRRER HEATING SYSTEM

CROSS REFERENCE TO RELATED CASES

This is a continuation of application Ser. No. 954,718 filed Oct. 24, 1978 which is a continuation of application Ser. No. 754,064, filed Dec. 23, 1976 now both abandoned.

BACKGROUND OF THE INVENTION

Microwave ovens have used cavities containing mode stirring structures to provide varying electric field patterns in the cooking area of the oven by introducing microwave energy into a cavity, which generally has interior dimensions large with respect to a wavelength of the microwave frequency, and moving conductive elements in the cavity to reflect the energy and vary the patterns so that points of maximum voltage gradients are continuously shifted in the cavity to more uniformly heat different sizes and shapes of bodies. Such a reflective mode stirrer, which is designed for one set of load conditions such as heating hamburgers or hot dogs, does not produce the same effectiveness in uniformly heating a large body such as a roast or a wide relatively planar body such as a pie.

Coaxial feeds of microwave energy into microwave heating cavities with mode stirrers rotating concentric with the feed have still provided that the mode stirring be by reflection from metal members moving with respect to the food body as shown, for example, in U.S. Pat. No. 3,436,507, issued on Apr. 1, 1969 to H. A. Puschner.

SUMMARY OF THE INVENTION

The present invention provides for a mode stirrer in a microwave oven with microwave energy radiated directly into the oven cavity from a plurality of movable antenna regions in the mode stirring structure so that the electric field mode patterns are varied predominantly by varying the position of the radiation patterns radiating from the antenna regions.

This invention further provides that the radiating antennae are ports in the mode stirring structure which are positioned within the cavity such that the radiation pattern of each of the ports covers a region wherein the body to be heated is placed, and such ports are moved with respect to said region so that a substantial portion of radiation is absorbed by the body to be heated without reflection from the cavity walls. More specifically, this invention provides that such radiation patterns are formed by ports rotating about a common axis at different distances from said axis, hence providing different toroidal regions of impingement on the body being heated. In addition, the radiating ports preferably are positioned along radii from the axis of rotation which are separated by substantially equal angles so that coupling and/or interference between the radiating beam patterns prior to impingement on reflecting walls of the oven is minimized. In addition, the radiating ports are preferably oriented to produce substantial radiation parallel to said axis.

This invention further provides that such a radiation mode pattern provides a region outside the primary radiation pattern prior to reflection of the oven walls in which additional heating elements such as resistance heaters or flame burner structures may be positioned. More specifically, a resistance heating unit may be formed with a substantially arcuate shaped portion and be positioned below a mode stirring structure in the oven cavity and having a radius of curvature larger than the maximum distance from the axis of rotation of the mode stirring structure to transfer heat by radiation and/or convection through the air to a body to be heated without interfering with the primary radiation patterns of the mode stirring structure.

This invention further provides that air may be circulated within the oven by a blower or fan action of the mode stirring structure to assist in the transfer of heat by conduction through the air from the resistive heater and/or to assist in maintaining the oven substantially free of surface wall deposits from condensed gases driven off from the body being heated.

This invention provides for a coaxial feed structure which rotates with respect to a body to be heated about an axis substantially concentric with the coaxial feed while radiating microwave energy in a direction predominantly parallel to said axis whereby annular rings of substantially equal energy radiation are produced concentric with said coaxial feed.

This invention further provides for supplying energy through said feed to a heating cavity having a reflective wall substantially perpendicular to said axis of rotation spaced from said radiating mode stirrer, with the ports of said stirrer being positioned at different distances from said axis whereby energy reflected from said wall substantially cancels upon re-entering said feed structure and, hence, is prevented from feeding back to the energy source. More specifically, this invention provides for positioning said ports on radii from said axis which are spaced apart by 120 degrees to form a three-phase radiating system, and the magnitude of the power radiated from each port is chosen by choosing the dimensions of the radiating ports, with said radiating ports being at different distances along said radii whereby energy reflected from said surface returns to the coaxial radiator at different phases and amplitudes which substantially cancel.

BRIEF DESCRIPTION OF THE DRAWINGS

Other and further objects and advantages of the invention will become apparent as the description thereof progresses, reference being had to the accompanying drawings wherein:

FIG. 3 illustrates an enlarged view of the mode stirrer section of FIG. 1;

FIG. 4 illustrates an enlarged detail of the mode stirrer section of FIG. 2.

DESCRIPTION OF THE PREFERRED EMBODIMENT

Figure 1:
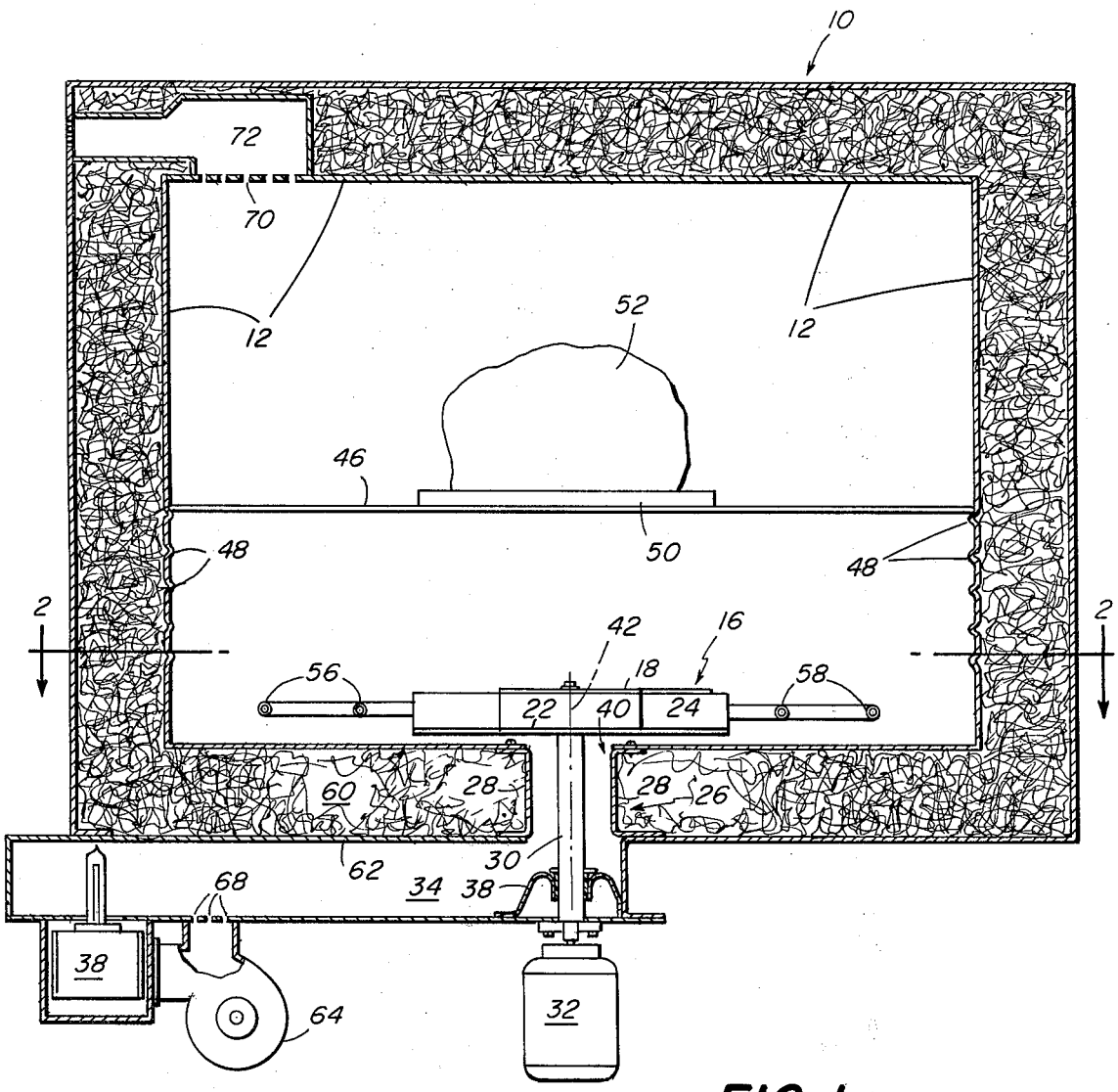
FIG. 1 illustrates a vertical sectional view taken along line 1—1 of FIG. 2 of a microwave oven embodying the invention.
Figure 2:
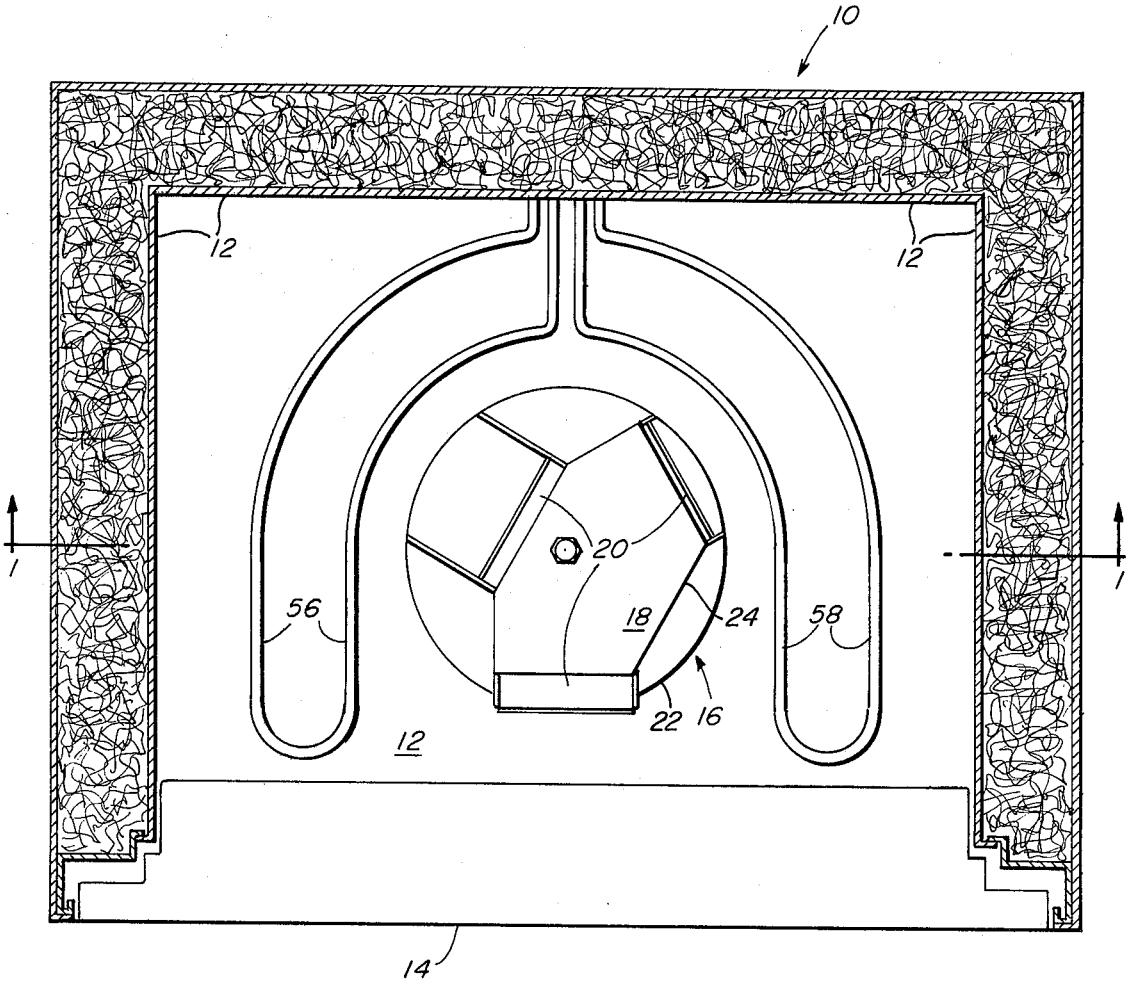
FIG. 2 illustrates a horizontal sectional view of the oven illustrated in FIG. 1 taken along line 2—2 of FIG. 1.

Referring now to FIGS. 1 and 2, there is shown a microwave oven 10 comprising a cooking enclosure 12 formed of metal and having a door 14 which closes an access opening in the enclosure 12.

Positioned in oven 10 is a microwave energy feed structure 16 comprising a flat plate structure 18 having slots 20 therein through which microwave energy radiates into the interior of the oven. A microwave feed cavity formed by a plate 22 positioned below plate 18 and connected to plate 18 by an outer wall member 24 is supplied with microwave energy by a coaxial line 26 whose outer conductor 28 is fixed with respect to the oven and whose inner conductor 30 extends outside the oven to a motor 32 which rotates feed structure 16 about an axis concentric with coaxial feed 26.

Outer conductor 28 of coaxial line 26 is connected to waveguide 34 while inner conductor 30 extends through the waveguide 34 to feed microwave energy from the waveguide 34 through the feed structure 16 into the enclosure 12. Waveguide 34 is supplied with microwave energy from a magnetron 36 in accordance with well-known practice.

As shown in detail in FIGS. 3 & 4 impedance matching structures 38 and 40 around coaxial feed 30 provide transitional impedance matching between the waveguide 34 and the coaxial line 26 and between the coaxial line 26 and the microwave feed structure 30. Structure 38 also acts with conductor 30 as a choke to prevent microwave energy from leaking out toward motor 32.

The openings 20 are radiating antennae, also referred to as radiating ports, positioned at different distances from the axis of rotation of the structure 16 and are shown, for example, as three openings oriented about said axis at 120-degree angles with respect to each other. The ports 20 are spaced from the axis of rotation 16, for example, by different distances.

While distances of ports 20 from said axis may be other than those shown, such distances preferably differ by amounts which cause energy reflected from the opposite oven wall to cancel in the stirrer feed cavity due to out of phase summation at the center conductor 30. In addition, the apertures 20 are preferably spaced at right angles to radii of the axis of rotation as elongated slots perpendicular to said radii, with the length of said slots being on the order of a wavelength of the energy and the width of the slots being less than a quarter wavelength of the energy so that the radiation from the slots will be in the TEM mode with the electric lines parallel to the radii through the axis of rotation of the structure.

The power radiated from each port 20 is dependent on the width of that port, and any desired pattern can be achieved by selecting the port width. However, the radiating port furthest from the axis of rotation preferably radiates the most power. Also, the distance from the axis of rotation to the center of the innermost slot at the end of the slot is preferably nearly as great as the distance radially from the axis of rotation to the center of the closest portion of the next slot and, similarly, the distance of the end portions of the middle slot are less than the distance from the axis of rotation to the closest point of said furthest slot so that when the structure 16 rotates, the areas of the slots sweep out overlapping toroidal regions.

A wire grill 46 having opening dimensions greater than a wavelength of said radiation is positioned above the radiating structure 16. The position of grill 46 is adjustable by the structure 46 being slid in and out between bumps 48 and the side walls of the enclosure 12.

Positioned on support rack 46 is a dielectric plate 50 of, for example, pyroceram having a dielectric constant at the microwave frequency which is greater than unity and may be, for example, on the order of ten depending on the particular ceramic. Due to the difference in dielectric constant, the field pattern radiated from the slots 20 is caused to converge slightly into a food body 52 supported thereon. Food body 52, as shown, is supported in a dish 54 and may constitute, for example, a roast of meat or other food bodies to be heated or cooked.

Positioned around the outside of rotating feed 16 are resistive heating elements 56 and 58 which may be used before, after, or during the application of microwave energy to the food body 52. Elements 56 and 58 may, for example, in a typical oven have a resistive heating capacity of one kilowatt per element and heat the oven and the body by radiation as well as by convection.

The motor 32 and feed structure 34 are positioned outside the enclosure 12 whose outside is preferably insulated, for example, by insulation 60 held in place by an outer oven skin 62. Therefore the waveguide structure 34 and coaxial oven feed are not overheated when the resistance heating elements are operating. In addition, cooling air is supplied by a blower 64 driven by an electric motor 66 which cools the anode of magnetron 36 by blowing air past fins on the magnetron and cools waveguide structure 34 by blowing air into waveguide structure 34 through apertures 68 in the waveguide structure 34. A portion of the air is blown through the coaxial feed 26 and out into the oven through ports 20 to aid in circulation of the heat in the oven and to exhaust cooking gases through apertures 70 in the enclosure 12, such vapors being processed in a canister 72 in accordance with well-known practice so that the air exhausted from canister 72 may be exhausted directly into the kitchen.

Figure 5:
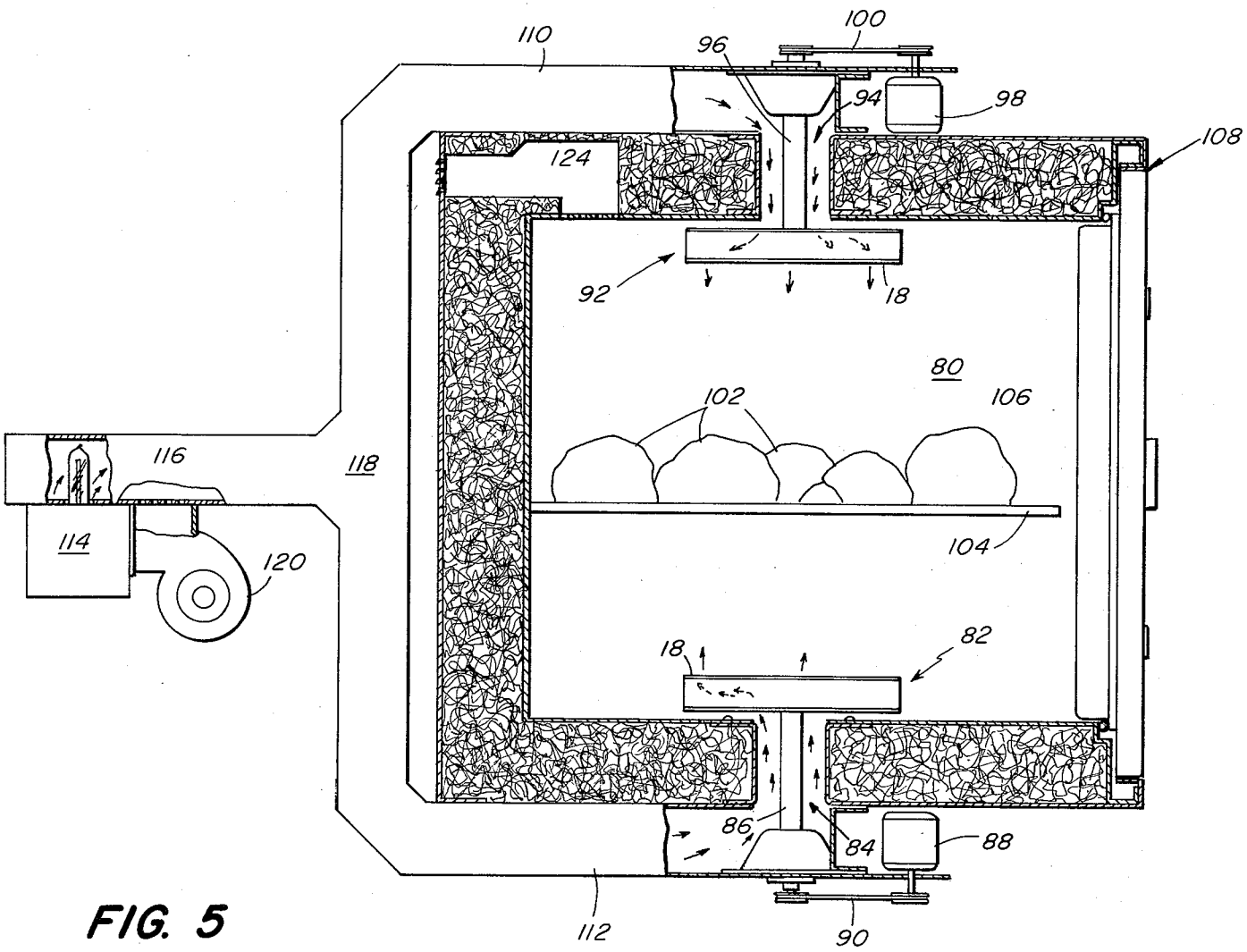
FIG. 5 illustrates a further embodiment of the invention.

Referring now to FIG. 5, there is shown a modification of the invention wherein two rotary feed mode stirring structures are positioned in a microwave heating cavity 80. More specifically, microwave heating cavity 80 has a mode stirring structure 82 positioned in the bottom thereof fed through the floor of the cavity by a coaxial line 84 and rotated by a central conductor 86 of the coaxial line driven by a motor 83 through a belt 90. An upper mode stirring structure 92 is similarly fed with microwave energy through a coaxial line 94 and rotated by central conductor 96 of coaxial line 94 which is driven by a motor 98 through a belt 100.

Mode stirring radiating structures 82 and 92 which are similar to structure 16 are rotated about a common axis in opposite directions so that the field patterns radiating from the ports 20 in the faces 18 of the mode stirrers cross each other as the mode stirrers rotate thereby creating additional pattern variation. The port sizes and structures for the mode stirrer may be, for example, like those disclosed for FIGS. 1, 2, 3 and 4. However, other sizes and shapes may be used.

Bodies to be heated 102 are preferably supported on a shelf 104 which is transparent to the radiated energy from stirrer 82 so that the bodies 102 are positioned substantially equidistant between the radiating mode stirrers 82 and 92, the bodies 102 being inserted or removed from the cavity 80 through a door 106 having a microwave seal 108 between the periphery of the door and the adjacent wall.

Microwave energy radiated into cavity 80 may be in the frequency range having a free space wavelength from one to 100 centimeters. For the batch processor shown herein as, 915 megahertz is preferable while for smaller bodies 52, 2450 megahertz may be preferable. The microwave energy is supplied to upper and lower coaxial lines 94 and 84 through waveguide sections 110 and 112, respectively, which are fed from a common microwave source 114, such as a magnetron, through a waveguide 116 and a T-section 118. In such a structure, microwave energy radiated, for example, from the upper mode stirring radiator 92 has a portion which passes through food bodies 102 without absorption to impinge on lower radiator 82 and a portion thereof is coupled back through coaxial line 84 to the waveguide 110. However, since such energy on reaching the T section 118 will have only a fraction thereof coupled back to the magnetron 114 with the rest being coupled to the waveguide portion 110 and back to the mode stirring radiator 92, the isolation of the magnetron 114 from energy fed back from the cavity is greater than that which would occur if only one of the mode stirring radiators 82 and 92 were used. For this reason, the magnetron 114 may have its output coupled closer to the waveguide 116 and hence closer to its maximum efficiency operating conditions without changes in the energy absorption produced by different points of the heating cycle of the load 102 or different loads, causing excess reflection of power to the magnetron 114 which could damage the magnetron by overheating.

While the magnetron 114 is shown herein as cooled by air from a blower 120, a water cooled magnetron could be used and, in any event, some of the air from the blower 10 is preferably coupled into the waveguide 116 through ports 122 to be directed through the waveguides 110 and 112 and the coaxial lines 84 and 94 into the cavity 80 to carry away gases produced by the heating which are exhausted through an outlet canister 124.

This completes the description of the embodiments of the invention illustrated herein. However, many modifications thereof will be apparent to persons skilled in the art without departing from the spirit and scope of this invention. For example, the mode stirring radiators could be moved in paths other than circular, the feeds to the mode stirring structures could be other than coaxial lines such as, for example, waveguides, and the structure could be used in continuous processing applications in which a conveyor belt moves bodies to be heated past the rotary mode stirring radiators. Accordingly, it is desired that this invention be not limited by the particular details illustrated herein except as defined by the appended claims.

What is claimed is:

1. A microwave heating system comprising:

a conductive enclosure;

a source of microwave energy positioned outside said enclosure;

means positioned in said enclosure for radiating a plurality of simultaneous microwave energy beams having different polarization vectors, said radiating means comprising a primary radiating structure formed by a flat metal plate having at least three elongated slot antennas formed therein, the longitudinal sides of said antennas being substantially perpendicular to imaginary radial lines emminating from a central region of said plate;

said radiating structure further comprising means for providing radial waveguides from said central region to each of said slots, said plate providing one conductor surface of said waveguides;

means for coupling microwave energy from said source to said radiating structure, said coupling means comprising a cylindrical conductive member extending through a hole in a wall of said enclosure, said radiating structure being supported by said member; and means for rotating said member about its cylindrical axis.

2. The microwave heating system recited in claim 1 wherein said slots are positioned at different distances from said central region of said plate.

3. The microwave heating system recited in claim 1 wherein said coupling means comprises a coaxial transmission line comprising said cylindrical conductive member.

* * * * *